US007222841B2

(12) United States Patent
Boxsell

(10) Patent No.: US 7,222,841 B2
(45) Date of Patent: May 29, 2007

(54) AIR AND HEAT EXCHANGE APPARATUS

(75) Inventor: Desmond James Boxsell, Burbank (AU)

(73) Assignees: Desmond J. Boxsell, Burbank, Queensland (AU); Lynette M. Boxsell, Burbank, Queensland (AU)

( * ) Notice: Subject to any disclaimer, the term of this patent is extended or adjusted under 35 U.S.C. 154(b) by 29 days.

(21) Appl. No.: 10/497,980

(22) PCT Filed: Dec. 3, 2002

(86) PCT No.: PCT/AU02/01632

§ 371 (c)(1),
(2), (4) Date: Sep. 27, 2004

(87) PCT Pub. No.: WO03/048668

PCT Pub. Date: Jun. 12, 2003

(65) Prior Publication Data

US 2005/0104237 A1 May 19, 2005

(30) Foreign Application Priority Data

Dec. 4, 2001 (AU) ..... PR9295

(51) Int. Cl.
*B01F 3/04* (2006.01)

(52) U.S. Cl. ..... 261/95; 261/113

(58) Field of Classification Search ..... 261/37, 261/94, 95, 97, 108, 110, 113, DIG. 75
See application file for complete search history.

(56) References Cited

U.S. PATENT DOCUMENTS

| | | | | | |
|---|---|---|---|---|---|
| 186,860 | A * | 1/1877 | Maynard | 261/109 |
| 516,590 | A * | 3/1894 | Convert | 261/113 |
| 1,804,554 | A * | 5/1931 | Dubbs | 196/139 |
| 2,934,326 | A * | 4/1960 | Strand | 261/113 |
| 3,359,074 | A * | 12/1967 | Dobo | 422/134 |
| 3,766,716 | A * | 10/1973 | Ruiz | 96/131 |
| 5,015,370 | A * | 5/1991 | Fricano | 210/138 |
| 5,637,231 | A * | 6/1997 | Hill et al. | 210/748 |
| 6,027,642 | A * | 2/2000 | Prince et al. | 210/180 |
| 6,354,514 | B1 | 3/2002 | Henricson et al. | |
| 6,623,635 | B2 * | 9/2003 | Barnes | 210/188 |

FOREIGN PATENT DOCUMENTS

| | | |
|---|---|---|
| DE | 3925203 A | 1/1991 |
| RU | 2041441 C1 | 8/1995 |
| RU | 2095720 C1 | 11/1997 |

* cited by examiner

*Primary Examiner*—Scott Bushey
(74) *Attorney, Agent, or Firm*—DeLio & Peterson, LLC; Peter W. Peterson

(57) ABSTRACT

A gas and heat exchange apparatus comprising at least one substantially vertical elongate hollow member, a plurality of internal members spaced inside the at least one hollow member, each internal member having at least one opening, means for gas intake and exhaust in fluid connection with the at least one hollow member, means for draining the at least one hollow member and a means for adding liquid to the upper end of the at least one hollow member.

8 Claims, 3 Drawing Sheets

AIR AND HEAT EXCHANGE APPARATUS

FIELD OF THE INVENTION

The present invention relates to a gas and heat exchange apparatus for use with a hydroponic growth system and in particular to one which increases the cooling and aeration of the water/nutrient mix whilst decreasing the loss of liquid due to evaporation.

BACKGROUND ART

In hydroponics, water/nutrients are generally kept in a large storage tank and recycled. This liquid is often heated through conduction or thermal heating by the sun. It must therefore generally be cooled before it can be applied to the plants. Also generally there can be a build up of noxious gases within the storage tank. If the storage tank is sealed, then those gases may be forced into solution. This gas may be deleterious to the plant life if absorbed.

Heat exchange apparatus, in general, are well known. In industrial processes, heat energy is transferred by a variety of methods, including conduction in electric-resistance heaters; conduction-convection in exchanges, dwellers, and condensers; radiation in furnaces and radiant-heat dryers; and by special methods such as dielectric heating.

The design and testing of practical heat-exchange equipment are based on the general principles of heat transfer. In simple devices, the vital quantities such as average temperature difference and heat transfer coefficient can often be evaluated easily and with considerable accuracy, but in complex processing units evaluation may be difficult and subject to considerable uncertainty. The final design of heat exchange equipment is nearly always a compromise, based on engineering judgment, to give the best overall performance in the light of service requirements.

Sometimes the design is governed by considerations which have little to do with heat transfer, such as the space available for the equipment or the pressure drop which can be tolerated in the fluid streams.

Heat exchangers are so important and so widely used in the process or chemical industries that the principles of their design have been highly developed. Standards devised and accepted by the Tubular Exchanger Manufacturers Association (T. E. M. A.) are available covering in detail areas such as materials, methods of construction, technique of design, and dimensions for exchangers. Most exchangers are liquid to liquid heat exchangers, but gases and non-condensing vapours can also be treated in them.

Already known are tubular type exchangers, and also plate type exchangers. A tubular type exchanger generally has a first fluid flowing in tubes inside a larger fluid tight shell. A second fluid flows in the shell, outside the tubes, either cooling or heating the fluid flowing in the tubes. This heating or cooling is generally accomplished mainly by conduction from the hot fluid to the cooler fluid through the tube wall, In plate type exchangers, metal plates, usually with corrugated faces, are supported in a frame; hot fluid passes between alternate pairs of plates, exchanging heat with the cold fluid in the adjacent spaces. The plates are typically approximately 5 mm apart. They can be readily separated for cleaning; additional area may be provided simply by adding more plates.

Other, more practical or readily available methods of heating or cooling are also known. One such method of heating is thermal heating. In this type of heating, fluids are stored in vessels, and the vessel is exposed to the sun. The heat energy from the sun heats the liquid inside the vessel.

Methods of cooling, similar in principle to thermal heating are also known. A simple example of evaporative cooling is known, particularly in off-road and long-distance trucking. In this method of cooling, a storage vessel is surrounded by cloth, the entire vessel and cloth then submerged in water, and attached to the front of a moving vehicle. Due to the speed of the moving vehicle and the air passing by the storage vessel, now surrounded with wet cloth, evaporation takes place. Due to the fact that evaporation requires heat energy to heat the water above a particular temperature, heat is absorbed from the water inside the storage vessel, thus cooling it.

The above methods of cooling and heating are not generally appropriate for small-scale hydroponics operations. Tubular type exchangers and plate type exchangers are very expensive and require large amounts of maintenance. For these reasons, they are often only found in large chemical plants. They are highly complex pieces of equipment and as such are not serviced easily by untrained operators. They require special knowledge and training which is not generally available to an ordinary user. They are generally suited only for large throughput situations.

Methods of the gas exchange are also known. Particularly mass-transfer operations known as gas absorption and stripping, or desorption are known.

In the gas absorption, a soluble vapour is absorbed from its mixture with an inert gas using a liquid in which the sought after gas is more or less soluble. The washing of ammonia from a mixture of ammonia and air by means of liquid water is a typical example. The solute gas is subsequently recovered from the liquid by distillation, and the absorbing liquid can either be discarded or reused. Sometimes a solute is removed from a liquid by bringing the liquid into contact with an inert gas; such an operation, the reverse of gas absorption, is called desorption or gas stripping.

The methods of gas exchange have disadvantages which are similar to the heat exchanger situation. They require special skills and training for operation of the required equipment and as such are not used by users without such training. They also are expensive pieces of equipment which are often quite large and complex and therefore are out of the budget of smaller users.

It simply would not be economically viable, nor practical, to use a conventional heat or gas exchanger, in a relatively small business such as a hydroponic primary producer. Often these large-scale pieces of equipment have their own problems, and as such would not meet the needs of a hydroponic grower.

OBJECT OF THE INVENTION

The present invention is directed to a gas and heat exchange apparatus, which may at least partially overcome the above-mentioned disadvantages or provide the consumer with a useful or commercial choice.

In one form, the invention resides in a gas and heat exchange apparatus, which has at least one substantially vertical elongate hollow member, a plurality of internal members spaced inside the at least one hollow member, each internal member having at least one opening, means for gas intake and exhaust in fluid connection with the at least one hollow member, means for draining the at least one hollow member and a means for adding liquid to the upper end of the at least one hollow member.

Preferably the internal members comprise insert members. Suitably the edges of each insert member are in substantially fluid tight connection with the internal surface of the at least one hollow member in which they are located.

There may preferably be three substantially vertical elongate hollow members making up each apparatus. Each of the three hollow members will preferably be the same, merely allowing more fluid to be treated than a single hollow member.

The hollow members may preferably be connected by connecting members disposed at each end of the hollow members. The connecting members may preferably be adapted to join the three hollow members to each other in a substantially fluid tight manner, The hollow members will preferably be tubular members. The outer diameter of each hollow member will preferably be between 50 and 300 mm The hollow members will preferably be manufactured from a rigid, strong but light material. A preferred material would be polyvinyl chloride (PVC) or plastic.

The connecting member at the upper end of the hollow members will preferably have an elbow joint at each end of the connecting member and also a third, T-shaped joint between the elbow joints. Each elbow joint will preferably be attached to the first and second hollow members respectively and the downcomer of the T-shaped joint will be attached to the third hollow member. Each elbow joint will preferably be connected to either side of the crosspiece of the T-shaped member via a length of connecting member.

The connecting member at the lower end of the hollow members will also preferably have an elbow joint at each end of the connecting member and also a third, T-shaped joint between the elbow joints. The connecting member of the upper end and the connecting member of the lower end of the hollow members will preferably be substantially similar in design.

The wall thickness of the hollow members and the connecting members will preferably be the same. It will preferably be between 1 mm and 25 mm. This wall thickness may be important in maintaining the vertical strength of the hollow members, and also the heat flux through the wall of the hollow members.

The length of the hollow members will preferably be between 1.5 m and 10 m. In order to maintain the vertical strength of the hollow members, they will suitably be approximately 6.5 to 7 m long. This will provide suitable length in which to accomplish the gas and heat exchange, but be short enough to maintain strength.

There may also preferably be a second member, disposed inside the substantially vertical hollow member, to provide support. The second member will preferably also be an elongate hollow member, and also preferably be constructed of the same material as the hollow members. It will suitably be of a smaller diameter, and be fixed within the hollow member in a concentric manner The second member will preferably be of equal length to the hollow member, and terminate at both ends in a plane common with the hollow member.

The second member shall preferably be spaced from the hollow member and held in position by the insert members. The second member shall be disposed substantially in the centre of the hollow member, so as to define an annular portion between the hollow member and the second member. It is in this annular portion that the heat and gas exchange will preferably take place. The ends of the second member will preferably be sealed in a substantially fluid tight manner to prevent any fluid flowing into the second member. This will force the fluid to flow preferably through the annular portion.

The orientation of the substantially vertical elongate hollow members when erected will preferably be to avoid all of the members being exposed to the sun at once. This means that the general orientation will be parallel to the East-West movement of the sun.

The hollow members will preferably be maintained in their substantially vertical orientation by a support frame attached to the hollow members. This support frame will preferably be manufactured out of a light metal such as steel. The support frame will preferably hold the hollow members above the ground, at a suitable height to engage with other hydroponic apparatus. Preferably the lowest portion of the hollow members will be held approximately at 1–2 m above the ground surface. The support frame will preferably be strong enough to maintain the vertical position of the hollow members even during violent storms.

The insert members will preferably be disk shaped members. They will preferably be planar and circular, matching the shape of the hollow members inside which they are located. The insert members will preferably have a central hole, which matches the outer diameter of the second member located inside the hollow member. The central hole will preferably engage with the second member and the insert members will be supported by the second member.

The insert members typically have an inner edge defined by the central hole, and an outer edge. The inner edge of each insert member will preferably be attached to the second member. The outer edge of each insert member will preferably be attached to the hollow member in which they are located. These attachments will preferably be in a substantially fluid tight manner to prevent any fluid flowing through these attachments. The method of attachment may be any conventional method, including adhesive means or collar means.

The insert members will suitably be separated vertically, The insert members will preferably be separated by an equal spacing. The separation shall preferably be accomplished by the method of attachment to the second member. The insert members will be held in their position by the method of attachment to the second member.

Preferably, there shall be at least three different types of insert member. The first type of insert member will be located at the upper and lower extremities of each hollow member. There shall preferably be one of the first type of insert member located at each of the upper and lower extremities of the hollow member. The first type of insert member will preferably be circular, have a central hole which is of a diameter to engage with the second member, and have a plurality of openings on its circular surface. The openings will preferably be holes to allow the flow of fluid through the insert member. The first type of insert member shall preferably provide an even distribution of fluid around the diameter of the hollow member.

The second type of insert member will preferably be located adjacent the upper first type of insert member. There shall preferably be 9 of the second type of insert member arrayed adjacent the upper first type of insert member. The second type of insert member will be circular, have a central hole which is of a diameter to engage with the second member, and have a plurality of openings on its circular surface. The openings will preferably be holes to allow the flow of fluid through the insert member. The plurality of openings shall preferably be of two different sizes. The first sized opening in the second type of insert member will preferably be approximately 40 mm in diameter. The second sized opening in the second type of insert member will preferably be approximately 15 mm in diameter. The two different sized openings will be alternated around the circular surface of the insert member.

The second type of insert member will preferably be covered by mesh member. The mesh member will preferably have openings which are approximately 1 mm square, but may be of any size and/or shape. The mesh member may preferably be constructed of "fly screens" mesh. This mesh member will be preferably attached to the second type of insert member to both its upper and lower circular surface. The mesh member will preferably assist the gas exchange.

The third type of insert member will be located adjacent the lowest second type of insert member, but above the lower insert member of the first type. There shall preferably be 3 of the third type of Insert member arrayed adjacent the lowest second type of insert member. The third type of insert member will be circular, have a central hole which is of a diameter to engage with the second member, and have a plurality of openings on its circular surface. The openings will preferably be holes to allow the flow of fluid through the insert member. The plurality of openings shall preferably be of two different sizes. The first sized opening in the third type of insert member will preferably be approximately 40 mm in diameter. The second sized opening in the third type of insert member will preferably be approximately 20 mm in diameter. The two different sized openings will be alternated around the circular surface of the insert member.

The third type of insert member will preferably be covered by a mesh member. The mesh member will preferably have openings which are smaller than 1 mm square. The mesh member may preferably be constructed of "sailing cloth" mesh. This mesh member will be preferably attached to the third type of insert member to both its upper and lower circular surface. The weave of the mesh member attached to the third type of insert member will preferably be much smaller than the weave of the mesh member attached to the second type of insert member. The mesh member will preferably further assist the gas exchange.

The insert members will all preferably be fixed to the hollow member such that the openings on the insert members are not aligned This will suitably ensure that the fluid flowing through the hollow member does not have a fixed flow path. This will preferably provide a degree of agitation to the fluid.

The insert members are preferably constructed of a rigid yet strong material. Preferably the material will also be light, and as such a material such as polyvinyl chloride (PVC) or other plastic is preferred.

The means for gas intake and exhaust will preferably be T-shaped. The vertical portion of the T-shaped means is preferably attached to the connecting member at the upper end of the hollow members. This will suitably position the means for gas intake and exhaust approximately 8 m above ground level.

The crosspiece of the T-shaped means will preferably have elbow joints on either end. The perpendicular portion of the elbow joints will preferably extend downward. At the lower extremity of the perpendicular portion, there shall preferably be a mesh cap member. The mesh cap member will preferably be dome shaped. There will preferably be more than one T-shaped means connected to the connecting member at the upper end of the hollow members.

The means for gas intake and exhaust will preferably be manufactured from polyvinyl chloride (PVC) or other plastic pipe, The diameter of the members comprising the means for gas intake and exhaust will preferably be smaller than that of the hollow members.

The means for gas intake and exhaust will preferably be in fluid contact with the connecting member at the upper end of the hollow members, and therefore also be in fluid contact with the hollow members themselves. This will preferably allow the flow of gases, particularly air, into and out of the hollow members.

The connection of the means for gas intake and exhaust to the connecting member at the upper end of the hollow members will preferably be such that the orientation of the means for gas intake and exhaust with respect to the hollow members may be changed. Preferably the means for gas intake and exhaust may be located above the hollow members, they may also be arrayed on an angle to the hollow members. The means for gas intake and exhaust are preferably located to avoid the intake of ground level heat and dust.

The means for draining the hollow member will preferably be a hole in the connecting member at the lower end of the hollow members. This hole will preferably be in substantially fluid tight connection with an elongate tubular member leading to a storage tank or to a hydroponic apparatus Preferably the hole will be disposed towards the underside of the connecting member to allow draining of the hollow member under the force of gravity.

The means for adding liquid to the upper end of the hollow members will preferably be a system of pipes leading from a storage tank or from a hydroponic apparatus. This will allow the collection and recycling of any water/nutrient added to the hollow members. The pipes will preferably be constructed or polyvinyl chloride (PVC) or plastic. The system of pipes will preferably be operatively associated with a pump means, to pump the water/nutrient from the storage tank or hydroponic apparatus to the upper end of the hollow members. At this point gravity will preferably take over and act to draw the liquid down through the hollow members to the means for draining the hollow members.

The system of pipes will preferably be attached to the outside of the hollow members. There will preferably be only one pipe carrying water/nutrient to the upper end of the hollow members. At the upper end of the carrying pipe, will be a T-shaped Joint which will allow splitting of the flow of water/nutrient into separate streams, each stream entering one of the hollow members and the liquid may flow downward towards the means for draining the hollow members.

The water/nutrient will preferably enter the hollow members through substantially fluid tight openings in the connecting member at the upper end of the hollow members. The fluid will then flow directly onto the first type of insert member which will have the effect of dispersing the fluid evenly about the annular portion of each of the hollow members.

Due to the pressure effect of pumping the water/nutrient into the upper end of the hollow members, air will be drawn from outside the hollow members, through the gas intake and exhaust means, into the hollow members.

This air will then be mixed with the water/nutrient as it travels downward through the hollow members. Mass transfer may also occur about any of the insert members, or in the hollow member in general.

BRIEF DESCRIPTION OF THE DRAWINGS

An embodiment of the invention will be described with reference to the following drawings, in which.

BEST MODE

Figure 1:
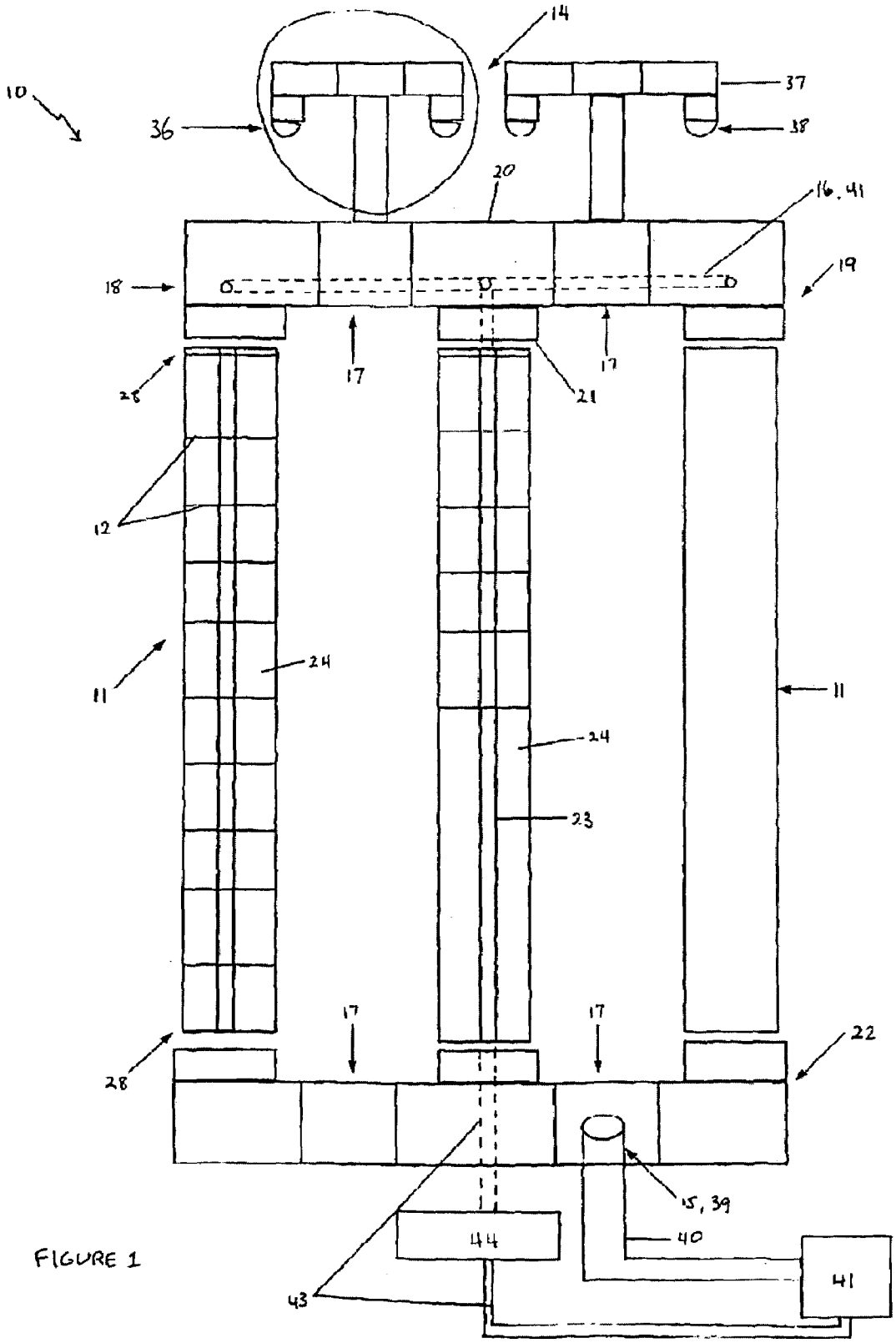
FIG. 1 is an elevation view of the apparatus.
Figure 2A:
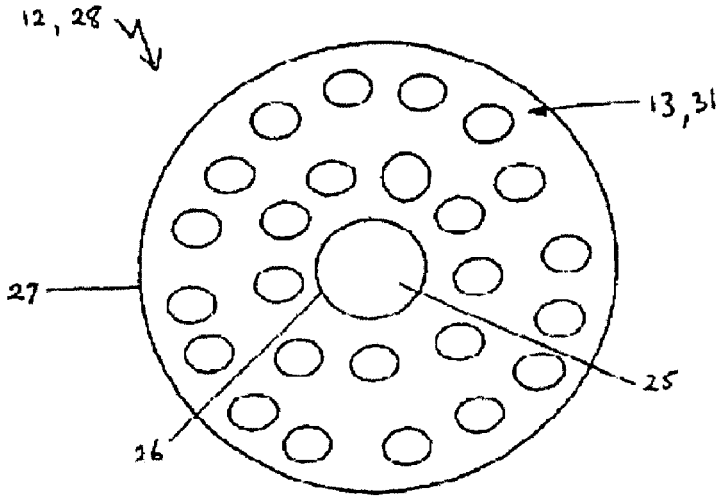
FIG. 2A is a plan view of the first type of insert member.
Figure 2B:
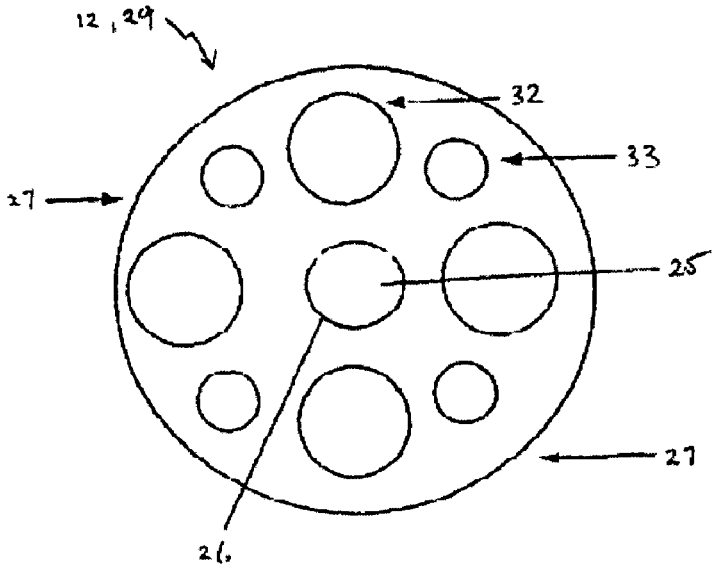
FIG. 2B is a plan view of the second type of insert member.
Figure 2C:
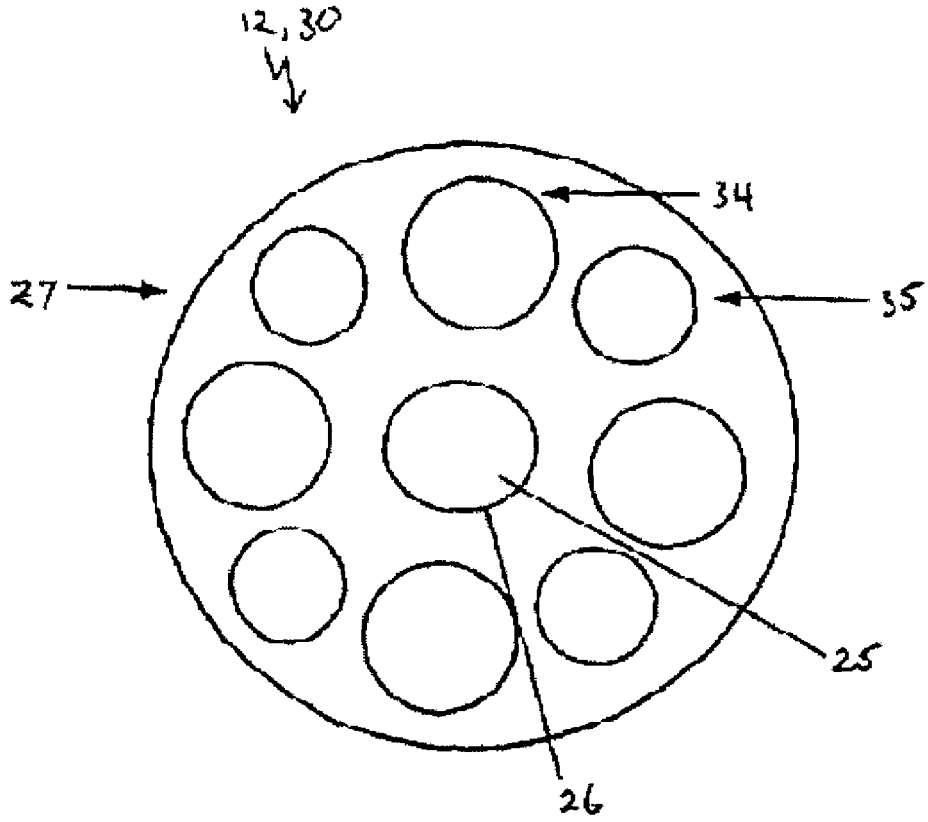
FIG. 2C is a plan view of the third type of insert member.

According to the embodiment depicted herein, the invention resides in a gas and heat exchange apparatus 10, which has at least one substantially vertical elongate hollow member 11, a plurality of insert members 12 spaced vertically inside the hollow member 11, the edges of each insert member 12 being in substantially fluid tight connection with the internal surface of the hollow member 11, each insert member 12 having a plurality of openings 13, means for gas intake and exhaust 14 in fluid connection with the hollow member 11, means for draining the elongate hollow member 15 and a means for adding liquid 16 to the upper end of the hollow member.

There are three substantially vertical elongate hollow members 11 making up each apparatus 10. Each of the three hollow members 11 is the same, both internally and externally, allowing more fluid to be treated than that possible by a single hollow member 11.

The hollow members 11 are connected by connecting members 17 disposed at each end of the hollow members 11. The connecting members 17 are adapted to join the three hollow members 11 in a substantially fluid tight manner to each other.

The hollow members 11 are elongate tubular members. The inner diameter of each hollow member 11 is approximately 150 mm. The hollow members 11 are manufactured from polyvinyl chloride (PVC) or plastic.

The connecting member at the upper end of the hollow members 18 has an elbow joint 19 at each end of the connecting member 18 and also a third, T-shaped joint 20 between the elbow joints 19. Each elbow joint 19 is attached to the first and second hollow members 11, and the downcomer of the T-shaped joint 21, will be attached to the third hollow member 11. Each elbow joint 19 is connected to either side of the crosspiece of the T-shaped member via a length of connecting member 17.

The connecting member at the lower end of the hollow members 22 also has an elbow joint at each end of the connecting member 22 and also a third, T-shaped joint between the elbow joints. The connecting member of the upper end 18 and the connecting member of the lower end 22 of the hollow members 11 are substantially similar in design.

The wall thickness of the hollow members 11 and the connecting members 17 is the same. It is approximately 9.5 mm. This wall thickness is important to maintain the vertical strength of the hollow members 11.

The length of the hollow members 11 is approximately 6 m in order to maintain the vertical strength of the hollow members 11. This will provide suitable length in which to accomplish the gas and heat exchange, but be short enough to maintain strength.

There is also a second member 23, disposed inside each substantially vertical hollow member 11, to provide support. The second member 23 is also an elongate hollow member, and is also constructed of the same material as the hollow members 11. It is of a smaller diameter, and fixed within the hollow member 11 in a concentric manner, The second member 23 is of equal length to the hollow member 11, and terminates at both ends in a plane common with the hollow member 11.

The second member 23 is spaced from the hollow member 11 and held in position by the insert members 12. The second member 23 is disposed substantially in the centre of the hollow member 11, so as to define an annular portion 24. It is in this annular portion 24 that the heat and gas exchange will take place. The ends of the second member 23 will preferably be sealed in a substantially fluid tight manner to prevent any fluid flowing into the second member 23. This will force the fluid to flow through the annular portion 24.

The orientation of the substantially vertical elongate hollow members 11 will be to avoid all of the members being exposed to the sun at once. This means that the general orientation will be parallel to the East-West movement of the sun.

The hollow members 11 are maintained in their substantially vertical orientation by a support frame attached to the hollow members 11. This support frame will be manufactured out of a light metal such as steel. The support frame holds the hollow members 11 above the ground, at a suitable height to engage with other hydroponic apparatus. Generally, the lowest portion of the hollow members will be held approximately at 1–1.5 m above the ground surface. The support frame will preferably be strong enough to maintain the vertical position of the hollow members 11 even during violent storms.

The insert members 12 are disk shaped members. They are planar, circular members matching the shape of the hollow members 11 inside which they are located. The insert members 12 have a central hole 25, which matches the outer diameter of the second member 23 located inside the hollow member 11. The central hole 25 engages with the second member 23 and the insert members 12 will be supported by the second member 23.

The insert members 12 have an Inner edge 26 defined by the central hole 25, and an outer edge 27. The inner edge of each insert member 26 is attached to the second member 23. The outer edge of each insert member 27 is attached to the hollow member 11 in which they are located. These attachments will preferably be in a substantially fluid tight manner to prevent any fluid flowing through these attachments. The method of attachment may be any conventional method, including adhesive means or collar means.

The insert members 12 are separated vertically. The insert members 12 are separated by an equal spacing. The separation is accomplished by the method of attachment to the second member 23. The insert members 12 will be held in their position by the method of attachment to the second member 23.

There are three different types of insert member 12. The first type of insert member 28 will be located at the upper and lower extremities of the hollow member 11. There Is one of the first type of insert member 28 located at each of the upper and lower extremities of the hollow member 11. The first type of insert member 28 is circular, have a central hole 25 which is of a diameter to engage with the second member 23, and have a plurality of openings on its circular surface 31. The openings 31 are holes to allow the flow of fluid through the insert member 12. The first type of insert member 28 is fitted to provide an even distribution of fluid around the diameter of the hollow member 11.

The second type of insert member 29 will be located adjacent the upper first type of insert member 28. There are 9 of the second type of insert member 29 arrayed adjacent the upper first type of insert member 28. The second type of insert member 29 will be circular, have a central hole 25 which is of a diameter to engage with the second member 23, and have a plurality of openings 31 on its circular surface.

The openings 31 are holes to allow the flow of fluid through the insert member. The plurality of openings shall preferably be of two different sizes. The first sized opening in the second type of insert member 32 is approximately 40 mm in diameter. The second sized opening in the second type of insert member 33 is approximately 15 mm in diameter. The two different the sized holes will be alternated around the circular surface of the insert member 12.

The second type of insert member 29 will preferably be covered by mesh member (not shown). The mesh member will have openings which are approximately 1 mm square. The mesh member is constructed of "fly screen" mesh. This mesh member is attached to the second type of insert member 29 to both its upper and lower circular surface. The mesh member will assist the gas exchange.

The third type of insert member 30 will be located adjacent the lowest second type of insert member 29. There are 3 of the third type of insert member 30 arrayed adjacent the lowest second type of insert member 29. The third type of insert member 30 will be circular, have a central hole 25 which is of a diameter to engage with the second member 23, and have a plurality of openings 31 on its circular surface. The openings 31 will preferably be holes to allow the flow of fluid through the insert member 30. The openings are of two different sizes. The first sized opening in the third type of insert member 34 is approximately 40 mm in diameter. The second sized opening in the third type of insert member 35 is approximately 20 mm in diameter. The two different the sized holes will be alternated around the circular surface of the insert member 30.

The third type of insert member 30 is covered by a mesh member. The mesh member has openings which are smaller than 1 mm square The mesh member is constructed of "sailing cloth" mesh. This mesh member will be attached to the third type of insert member 30 to both its upper and lower circular surface. The weave of the mesh member attached to the third type of insert member 30 is much smaller than the weave of the mesh member attached to the second type of insert member 29. The mesh member will further assist the gas exchange.

The insert members 12 will all preferably be fixed to the hollow member 11 such that the openings on the insert members 12 are not aligned. This will ensure that the fluid flowing through the hollow member does not have a fixed flow path. This will provide a degree of agitation to the fluid.

Insert members 12 are constructed of a rigid yet strong material, preferably such a material such as polyvinyl chloride (PVC) or other plastic. The means for gas intake and exhaust 36 will preferably be T-shaped. The vertical portion of the T-shaped means 36 is attached to the connecting member at the upper end of the hollow members 18. This will position the means for gas intake and exhaust 36 approximately 8 m above ground level.

The crosspiece of the T-shaped means 35 has elbow joints on either end. The perpendicular portion of the elbow joints extend downward. At the lower extremity of the perpendicular portion, there is a mesh cap member 36. The mesh cap member is dome shaped. There is more than one T-shaped means connected to the connecting member at the upper end of the hollow members 18.

The means for gas intake and exhaust 36 is manufactured from polyvinyl chloride (PVC) or other plastic pipe. The diameter of the means is smaller than that of the hollow members 11.

The means for gas intake and exhaust 36 is in fluid contact with the connecting member at the upper end of the hollow members 18, and therefore also be in fluid contact with the hollow members 11 themselves. This will allow flow of gases, particularly air, into and out of the hollow members 11.

The connection of the means for gas intake and exhaust 36 to the connecting member at the upper end of the hollow members 18 is such that the orientation of the means for gas intake and exhaust 36 with respect to the hollow members may be changed. The means for gas intake and exhaust 36 may be located above the hollow members 11, they may also be arrayed on an angle to the hollow members 11. The means for gas intake and exhaust 36 are located to avoid the intake of ground level heat and dust.

The means for draining the hollow member 39 is a hole in the connecting member at the lower end of the hollow members 22. This hole 39 is in substantially fluid type connection with an elongate tubular member 40 leading to a storage tank 41. The hole is disposed towards the underside of the connecting member 22 to allow draining of the hollow member 11 under the force of gravity.

The means for adding liquid 42 to the upper end of the hollow members 11 is a system of pipes 43 leading from the storage tank 42. This will allow the collection and recycling of any water/nutrient added to the hollow members 11. The pipes are constructed of polyvinyl chloride (PVC) or plastic. The system of pipes 43 is operatively associated with a pump means 44, to pump the water/nutrient from the storage tank 42 to the upper end of the hollow members 11. At this point gravity will take over and act to draw the liquid down through the hollow members 11 to the means for draining the hollow members 39.

The system of pipes 43 is attached to the outside of the hollow members 11. There is only one pipe carrying water/nutrient to the upper end of the hollow members 11. At the upper end of the carrying pipe, will be a T-shaped joint which will allow splitting of the flow of water/nutrient into separate streams, each of which will then enter one of the hollow members 11 and flow downward towards the means for draining the hollow members 39.

The water/nutrient will preferably enter the hollow members 11 through substantially fluid type openings in the connecting member at the upper end of the hollow members 18. The fluid will then flow directly onto the first type of insert member 28 which will have the effect of dispersing the fluid evenly about the annular portion 24 of each of the hollow members 11.

Due to the pressure effect of pumping the water/nutrient into the upper end of the hollow members 11, air will be drawn from outside the hollow members 11, through the gas intake and exhaust means 36, into the hollow members 11. This air will then be mixed with the water/nutrient as it travels downward through the hollow members 11.

The apparatus operates as follows: water/nutrient is pumped from the storage tank 41 through the means for adding liquid 16 to the upper end of the hollow members 11. The liquid then falls under gravity's force through the elongate hollow members 11, and whilst doing so is mixed with the air coming in through the means for gas intake and exhaust 14. Due to the pumping action when adding liquid, air is actually sucked into the means for gas intake and exhaust 14, and it is this air that mixes with the liquid as it falls.

As the air coming into the hollow members 11, is generally cooler than the heated liquid from the storage tank 41, the liquid is also cooled. The insert members 12 act to increase the surface area of the liquid and also to promote the mixing of (te air with the liquid. The liquid at the bottom of the apparatus is a substantially cooler and higher in dissolved oxygen content then the liquid at the top of the apparatus. The liquid is then drained into the storage tank 41.

The system 10 is substantially fluid tight and as such prevents losses through evaporation and also acts to recycle the liquid. The system also acts to strip the water/nutrient liquid of any noxious gases which may be deleterious to plant life.

The invention has been described in language more or less specific to structural or methodical features. It is to be understood that the invention is not limited to specific features shown or described since the means herein described comprises preferred forms of putting the invention into effect. The invention is, therefore, claimed in any of its forms or modifications.

The invention claimed is:

1. A gas and heat exchange apparatus comprising three substantially vertical elongate hollow members, the hollow members being connected by connecting members disposed at each end of the hollow tubular members, the connecting members adapted to join the three hollow members to each other in a substantially fluid tight manner, the connecting member at the upper end of the hollow members having an elbow joint at each end of the connecting member and a third, T-shaped joint between the elbow joints, the T-shaped joint having a crosspiece and a downcomer, each elbow joint attached to a first and second hollow member respectively and the downcomer of the T-shaped joint attached to a third hollow member, each elbow joint connected to either side of the crosspiece of the T-shaped member via a length of connecting member, a plurality of internal members spaced inside each of the hollow members, each internal member having at least one opening through which at least one fluid may flow, means for gas intake and exhaust in fluid connection with the hollow members, means for draining the hollow members and a means for adding liquid to the upper end of the hollow members, wherein each internal member is substantially disc-shaped with an outer edge and the outer edges of each internal member are in substantially fluid tight connection with an internal surface of the hollow member in which they are located.

2. A gas and heat exchange apparatus according to claim 1 wherein, the connecting member at the lower end of the hollow members is substantially similar in design to the connecting member at the upper end.

3. A gas and heat exchange apparatus comprising at least one substantially vertical elongate hollow member, a plurality of internal members spaced inside the at least one hollow member, each internal member having at least one opening through which at least one fluid may flow, means for gas intake and exhaust in fluid connection with the at least one hollow member, means for draining the at least one hollow member and a means for adding liquid to the upper end of the at least one hollow member, wherein each internal member is substantially disc-shaped with an outer edge and the outer edges of each internal member are in substantially fluid tight connection with an internal surface of the at least one hollow member in which they are located, each hollow member has at least three different types of internal member:

at least one first type of internal member located at the upper and lower ends of the hollow member, the first type of internal member having a plurality of openings on its circular surface, the openings providing an even distribution of fluid around the diameter of the hollow member, at least one second type of internal member spaced from the upper first type of internal member, each second type of internal member having a plurality of openings on its circular surface, the openings of two different sizes, the first sized openings in the second type of internal member of approximately 40 mm in diameter, and the second sized openings in the second type of internal member of approximately 15 mm in diameter, the two different sized openings alternated around the circular surface of the internal member, and at least one third type of internal member spaced from the lowest second type of internal member and above the lower internal member of the first type, each third type of internal member having a plurality of openings on its circular surface, the openings of two different sizes, the first sized openings in the second type of internal member of approximately 40 mm in diameter, and the second sized openings in the second type of internal member of approximately 20 mm in diameter, the two different size openings alternated around the circular surface of the internal member.

4. A gas and heat exchange apparatus according to claim 3 wherein each second type of internal member is associated with a mesh member having a plurality of openings of approximately 1 mm width therein.

5. A gas and heat exchange apparatus according to claim 4 wherein each third type of internal member is associated with a mesh member having a plurality of openings therein which are smaller then the openings of the mesh member associated with the second type of internal member.

6. A gas and heat exchange apparatus according to claim 3 wherein the internal members are associated with the hollow member such that the openings on the internal members are not aligned.

7. A gas and heat exchange apparatus comprising at least one substantially vertical elongate hollow member, a plurality of internal members spaced inside the at least one hollow member, each internal member having at least one opening through which at least one fluid may flow, means for gas intake and exhaust in fluid connection with an upper end of the at least one hollow member to allow a flow of gases, particularly air, into and out of the at least one hollow member, the means for gas intake and exhaust being T-shaped, with a vertical portion of the T-shaped means associated with the upper end of the at least one hollow member, means for draining the at least one hollow member and a means for adding liquid to the upper end of the at least one hollow member, wherein each internal member is substantially disc-shaped with an outer edge and the outer edges of each internal member are in substantially fluid tight connection with an internal surface of the at least one hollow member in which they are located.

8. A gas and heat exchange apparatus according to claim 7 wherein the crosspiece of the T-shaped means has elbow joints on either end, the elbow joints associated with a filter cap member.

* * * * *